US009003575B2

(12) United States Patent
Mesun et al.

(10) Patent No.: US 9,003,575 B2
(45) Date of Patent: Apr. 14, 2015

(54) TOILETS WITH IMPROVED TRAPWAYS

(75) Inventors: Randy O. Mesun, Sheboygan, WI (US); Daniel N. Halloran, Saukville, WI (US)

(73) Assignee: Kohler Co., Kohler, WI (US)

( * ) Notice: Subject to any disclaimer, the term of this patent is extended or adjusted under 35 U.S.C. 154(b) by 1427 days.

(21) Appl. No.: 12/029,774

(22) Filed: Feb. 12, 2008

(65) Prior Publication Data

US 2009/0199332 A1 Aug. 13, 2009

(51) Int. Cl.
*E03D 11/18* (2006.01)
*E03D 11/08* (2006.01)

(52) U.S. Cl.
CPC ..... *E03D 11/18* (2013.01); *E03D 11/08* (2013.01)

(58) Field of Classification Search
USPC ..... 4/421, 420, 422, 423, 424, 428
See application file for complete search history.

(56) References Cited

U.S. PATENT DOCUMENTS

| | | | | | |
|---|---|---|---|---|---|
| 492,947 | A | * | 3/1893 | Smith | 4/428 |
| 1,062,413 | A | | 5/1913 | Payne | |
| 1,067,096 | A | | 7/1913 | Cochran | |
| 1,132,866 | A | | 3/1915 | Muckenhirn | |
| 1,221,359 | A | | 4/1917 | Muckenhirn | |
| 1,251,268 | A | | 12/1917 | Muckenhirn | |
| 1,964,876 | A | | 7/1934 | Gavin | |
| 2,066,883 | A | | 1/1937 | Groeniger | |
| 2,344,649 | A | * | 3/1944 | Sloan | 4/422 |
| 3,212,106 | A | * | 10/1965 | Noel | 4/421 |
| 3,484,873 | A | * | 12/1969 | Hoard | 4/428 |
| 4,145,776 | A | * | 3/1979 | Crosby et al. | 4/425 |
| 4,246,227 | A | | 1/1981 | Crosby et al. | |
| 5,170,515 | A | | 12/1992 | Kai et al. | |
| 5,404,597 | A | * | 4/1995 | Hennessy | 4/424 |
| 5,706,529 | A | | 1/1998 | Kai et al. | |
| 5,819,326 | A | | 10/1998 | Kobayashi et al. | |
| 5,918,325 | A | | 7/1999 | Arita et al. | |
| 5,983,413 | A | * | 11/1999 | Hayashi et al. | 4/420 |
| 6,145,138 | A | | 11/2000 | Nakamura et al. | |
| 6,986,172 | B2 | | 1/2006 | Hidetaka et al. | |
| 7,020,908 | B2 | | 4/2006 | Kuru et al. | |
| 2003/0213055 | A1 | | 11/2003 | Yoneda et al. | |
| 2004/0139538 | A1 | * | 7/2004 | Kuru et al. | 4/420 |

FOREIGN PATENT DOCUMENTS

| | | |
|---|---|---|
| CN | 1963051 | 5/2007 |
| GB | 452339 | 8/1936 |
| JP | 6-287990 | 10/1994 |
| JP | 2002-309655 | 10/2002 |
| TW | 263974 | 11/1983 |

OTHER PUBLICATIONS

PCT/US2009/000865 International Search Report, mailed May 28, 2009, 3 pages.

* cited by examiner

*Primary Examiner* — Lauren Crane
(74) *Attorney, Agent, or Firm* — Foley & Lardner LLP

(57) ABSTRACT

A toilet has a trapway extending between a bowl opening and a toilet outlet opening. A heel links and provides a bend between a down leg and an out leg of the trapway. The heel has a cross-sectional profile having a major dimension and a minor dimension. The major dimension increases as the down leg transitions into the heel and reduces as the heel transitions into the out leg. This heel configuration in the trapway forms a siphon during a flushing action of the toilet.

19 Claims, 6 Drawing Sheets

TOILETS WITH IMPROVED TRAPWAYS

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to toilets having siphonic outlet traps extending from their bowl. More particularly it relates to improvements in such traps to facilitate bowl cleaning with lower water usage.

Conventional toilets typically have a bowl portion connected to a serpentine outlet passage. An up leg portion of the passage is normally filled with water between flush cycles to "trap" sewer gases downstream thereof, so as to thereby prevent the sewer gases from entering the building interior.

Water is maintained in the bowl and the up leg part of the trapway by an arched portion of the trapway known as a "weir". A down leg of the trapway which is downstream of the weir is a leg that is designed to develop a siphon once the flushing cycle starts, to help further evacuate the bowl. Downstream of that is usually a cross leg to carry the flow to an outlet and also to help form the siphon in the down leg.

The trapway thus serves multiple purposes. It traps sewer gas, it helps retain water in the bowl prior to flushing, and it then assists in the formation of a siphon during the flush cycle. Achieving all of these functions is relatively straightforward when a large volume of water can be used during a single flush cycle (e.g. 3 gallons). However, primarily for water conservation reasons many jurisdictions now restrict, and consumers prefer not to use, toilets that use that much water per flush. It is now standard for toilets not to use more than 1.6 gallons (6.06 liters) of water per flush cycle.

Achieving effective cleaning when using that little water can be difficult. Hence, some early models of low water usage toilets had problems with cleaning effectiveness, which led to consumers flushing multiple times per visit. Others incorporated relatively expensive devices such as pumps to provide more force to the water that was used. While the art has now begun to develop less expensive ways to achieve effective cleaning with 1.6 gallons of water, there is a regulatory and market desire for toilets to work with even less water per flush.

One impediment to reducing the amount of water used per flush cycle more is that the process of forming the siphon in the siphon leg has in the past used a substantial amount of water. For example, a significant amount of water passed through the trapway before the siphon ever formed. Cutting down on the amount of time it takes to form the siphon is not a simple matter as there is a need to remove air trapped in the down leg and outlet leg, and as initial flow patterns through the trap vary depending on the nature of the waste in the bowl. Further complicating matters is that some purported solutions lead to clogging problems.

Representative of the current trapway art are U.S. Pat. Nos. 1,062,413, 1,132,866, 1,221,359, 1,251,268, 1,964,876, 2,066,883, 3,484,873, 4,246,227, 5,170,515, 5,404,597, 5,706,529, 5,819,326, 5,918,325, 5,983,413, 6,145,138, 6,986,172 and 7,020,908. See also U.S. patent application publication 2003/0213055.

Accordingly, there is still a need for improved trapways, particularly those which permit efficient bowl cleaning with very low levels of water usage per flush.

SUMMARY OF THE INVENTION

The invention provides a toilet having a trapway with improved water and air evacuation characteristics. In one aspect the trapway connects a bowl opening and a toilet outlet. The trapway extends from the bowl opening to a weir above the bowl opening, then to a down leg, then to a heel, and finally to an out leg.

The heel links and provides a bend between the down leg and the out leg. The heel has a cross-sectional profile having a major dimension and a minor dimension. The major dimension increases as the down leg transitions into the heel and reduces as the heel transitions into the out leg. The trapway is capable of generating a siphon during a flushing action of the toilet. Preferably, the minor dimension reduces as the down leg transitions into the heel and increases as the heel transitions into the out leg.

These changes in the major and minor dimensions "focus" the flow of water through the trapway at the heel. This heel geometry facilitates the formation of a siphon in the trapway during a flushing action of the toilet, and importantly does so in a way that is effective notwithstanding a wide variation of waste that might initially be in the bowl.

In a preferred form, the down leg and the out leg each have major and minor dimensions between 2 and 2.25 inches, while the heel has a major dimension of between 3.2 and 3.7 inches. In another preferred form, the trapway has a down leg with an essentially circular cross-sectional profile and an out leg with an essentially D-shaped cross-sectional profile. In this form at least a portion of the inner surface of the side wall of the heel has a flat portion that transitions into a flat bottom of the D-shaped out leg.

In other preferred forms, the maximum cross-sectional area of the heel exceeds the cross-sectional area of the down leg adjacent to the heel. For example, the maximum cross-sectional area of the heel can exceed the cross-sectional area of the down leg adjacent to the heel by at least 25 percent.

In yet another preferred form, the down leg is essentially vertical, while the out leg is essentially horizontal. In this form, the out leg may extend in a forward direction from the heel to the outlet.

The present invention provides a toilet with an improved trapway design. It is designed so that water from the bowl quickly fills key portions of the trapway during a flush cycle. This leads to rapid creation of a siphon. Additionally, the trapway design also better maintains the siphon as the water flow rate declines at the end of the flush cycle. Hence, the trapway design provides more rapid and consistent evacuation of the bowl contents, minimizing water waste.

This trapway geometry, and in particular the geometry of the heel connecting the down leg and the out leg, permits better utilization of the water during the flush cycle (e.g. more efficient splitting of water between the rim and any jet). The elongation and pinching of the heel improves the formation of a siphon in the trapway under varied water conditions while keeping the trapway free of clogs. Thus, even with relatively low amounts of water, the trapway provides an efficient, reliable, and robust flush.

These and still other advantages of the invention will be apparent from the detailed description and drawings. What follows is merely a description of preferred embodiments of the present invention. To assess the full scope of the invention the claims should be looked to as the preferred embodiments are not intended to be the only embodiments within the scope of the claims.

DETAILED DESCRIPTION OF THE PREFERRED EMBODIMENTS

Figure 1:
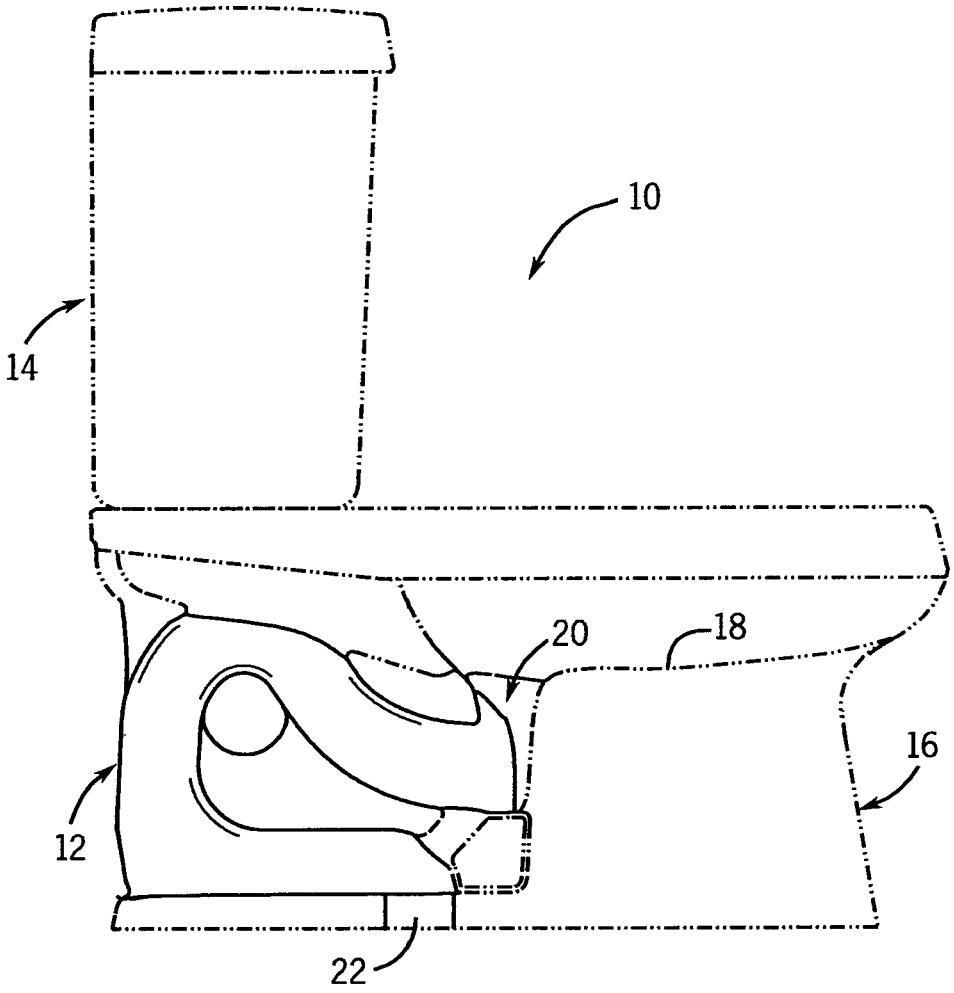
FIG. 1 is a left side elevational view of a toilet trapway according to the present invention, with an example environment that the trapway can used in being shown in dotted lines.

FIG. 1 illustrates a toilet 10 having a siphon passage or trapway 12 design according to the present invention. The toilet 10, apart from the specifics of the trapway 12, can be any suitable toilet, with the toilet of FIG. 11 being just one possible example.

As another example, FIG. 1 shows in dotted lines a two-piece type toilet having a flush tank 14 mounted to a bowl base 16. A hole (not shown) in the bottom of the flush tank 14 aligns with a hole (not shown) in the top of the bowl base 16 to allow water to pass from the flush tank and into a bowl 18, formed in the bowl base 16, during a flush cycle.

The trapway 12 extends from a bowl opening 20 in the bowl 18 along a serpentine path, and importantly has a cross-section that varies along the path (e.g. as shown in FIGS. 3-10). The trapway has an outlet opening 22 at the bottom of the bowl base 16, which mounts over the open end of a waste plumbing line (not shown). The trapway 12 thus creates a path for contents in the bowl 18 to flow to the waste/sewer/septic line during a flush cycle.

Figure 2:
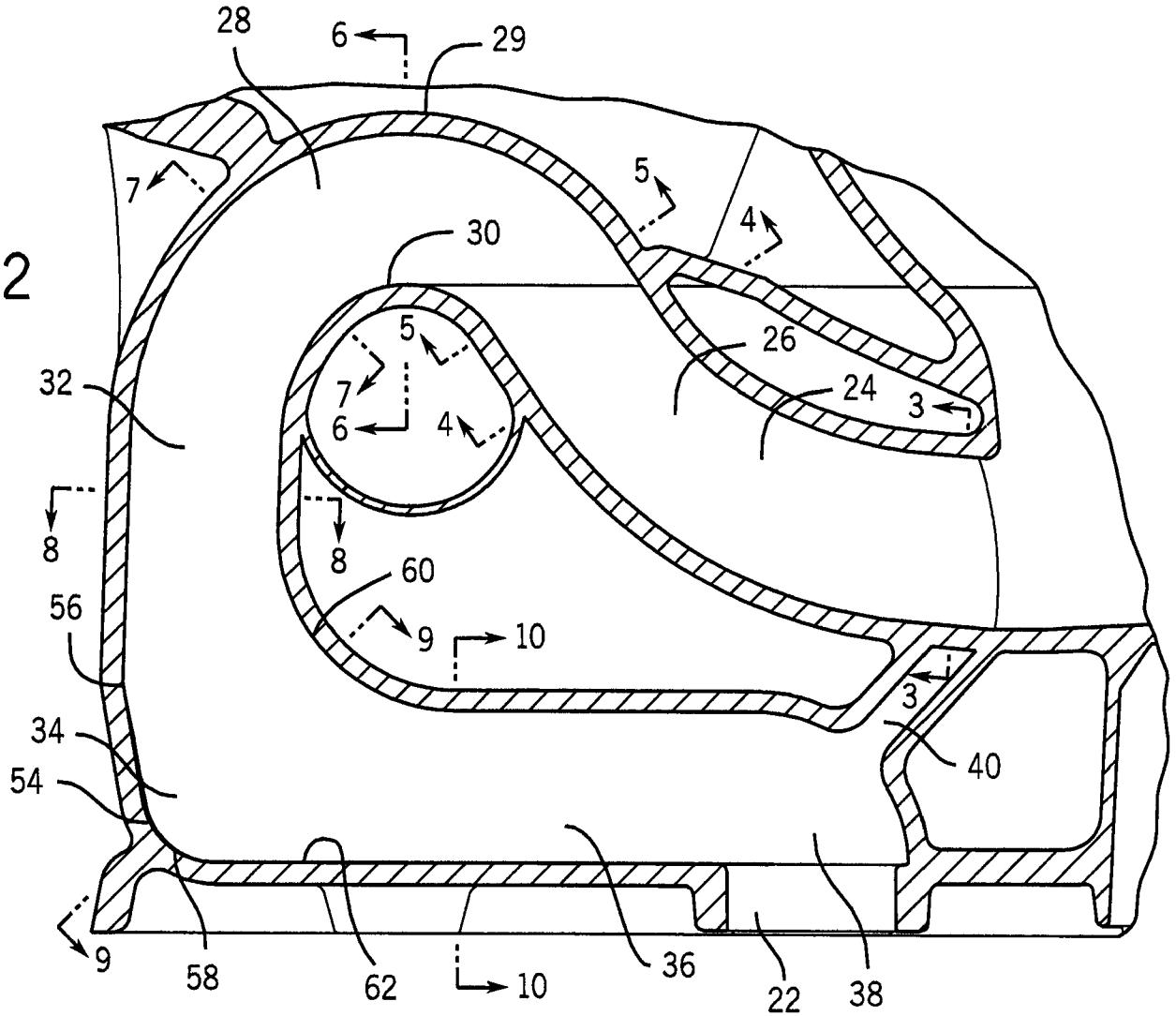
FIG. 2 is a vertical cross-sectional view taken down the front-to-back center line of the rear lower portion of the toilet of FIG. 1.

Referring next to FIG. 2, an entry 24 of the trapway 12 extends from a vertical portion of the bowl opening 20 to an up leg 26. The up leg 26 curves gradually in a rearward direction away from the entry 24 and up to a weir 28. The weir 28 arches such that the upper inner surface provides a weir peak 29 and the lower inner surface provides a water dam 30. The weir 28 arches over this water dam 30 to link to a down leg 32.

A heel 34 forms an approximately 90 degree bend that connects the down leg 32, which extends in an essentially vertical direction, to the out leg 36, which extends in an essentially horizontal direction. The out leg 36 extends in a forward direction towards the front of the toilet 10 until the out leg 36 connects to an outlet bend 38.

The outlet bend 38 bends approximately 90 degrees to then connect the out leg 36 to the outlet opening 22 which is adapted for connection to a waste/sewer/septic line (not shown). The outlet bend 38 may also have a cavity 40 extending from outlet bend 38 towards the upper portion of the trapway 12 and the bowl 18 which facilitates molding.

The shape of the cross sections vary over the length of the trapway 12. In each of FIGS. 3-10, a center line indicates the orientation of the cross section relative to the plane that was used to create the cross-sectional view in FIG. 2. In all of the cross-sectional profiles, side walls 42 enclose a passage 44 that runs through the trapway 12.

Figure 3:
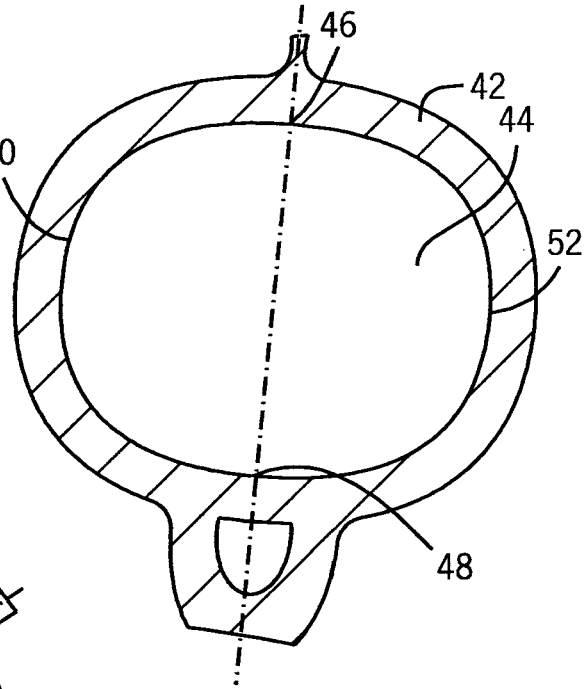
FIG. 3 is a cross-sectional view taken along line 3-3 of FIG. 2.

As used herein, when used with respect to the cross-sections shown in FIGS. 3-10, "medial" refers to a direction indicated by the line that lies in at the intersection of the plane on which the cross section shown in FIG. 2 and the plane of the cross section shown in each of the FIGS. 3-10. In contrast, "lateral" will refer to a direction that extends perpendicular to the plane on which the cross section shown in FIG. 2 was taken. Because of the symmetry of the trapway, in this embodiment, the medial and the lateral directions will always be perpendicular to one another. For clarification, axes indicating the medial direction M and the lateral direction L for the first cross section are shown in FIG. 3.

As the trapway 12 extends from the entry 24 to the weir 28, the cross-sectional profile of the trapway 12 changes as shown in FIGS. 3-6. FIG. 3 shows a cross section of the trapway 12 near the entry 24. The cross-sectional shape of the entry 24 is that of a relatively stout oval. The medial dimension between the top portion 46 and bottom portion 48 of inner surface of the side walls 42 is preferably about 2.4 inches and the lateral dimension between the left portion 50 and right portion 52 of the inner surface of the side walls 42 is preferably about 2.9 inches.

Figure 4:
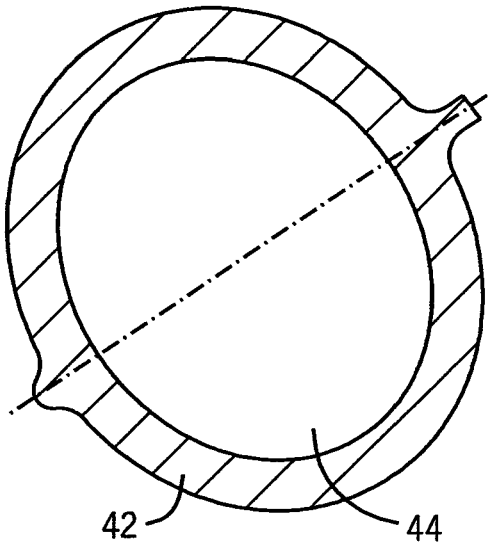
FIG. 4 is a cross-sectional view taken along line 4-4 of FIG. 2.
Figure 5:
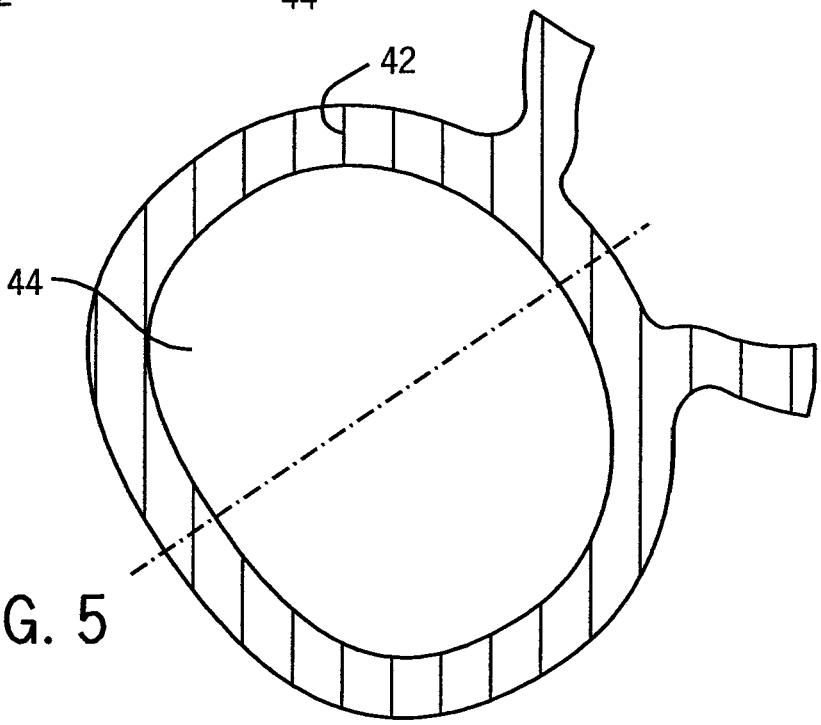
FIG. 5 is a cross-sectional view taken along line 5-5 of FIG. 2.
Figure 6:
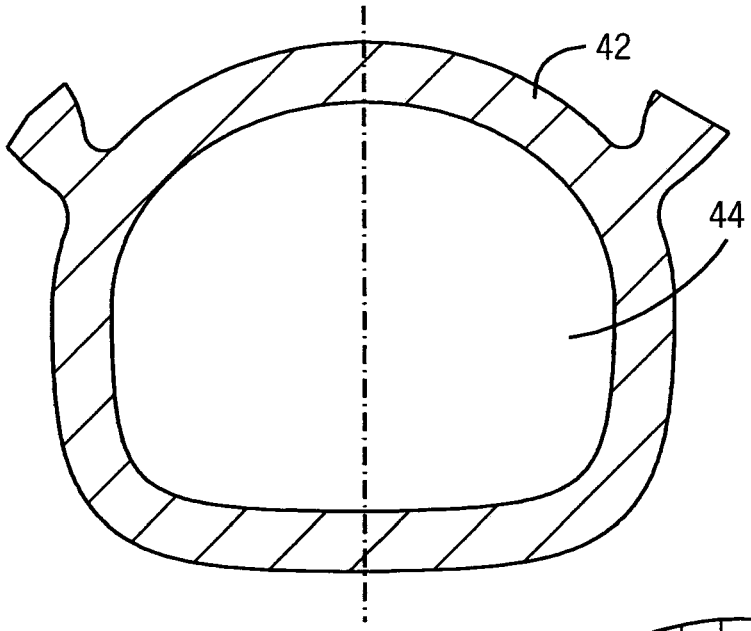
FIG. 6 is a cross-sectional view taken along line 6-6 of FIG. 2.
Figure 7:
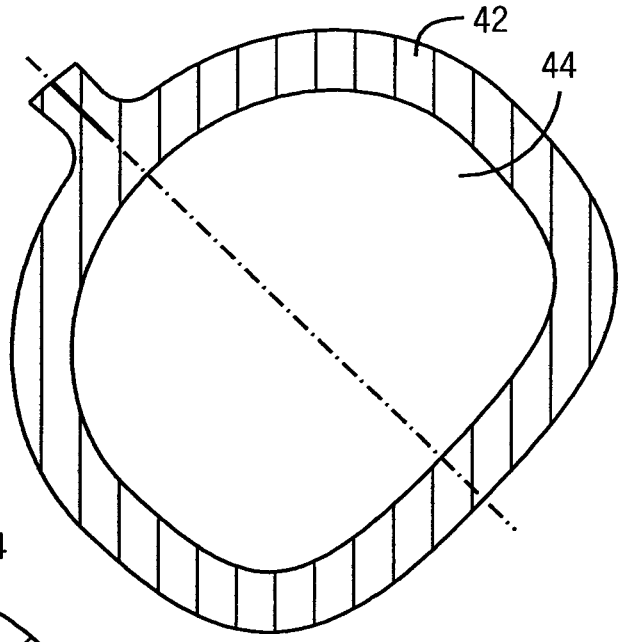
FIG. 7 is a cross-sectional view taken along line 7-7 of FIG. 2.
Figure 8:
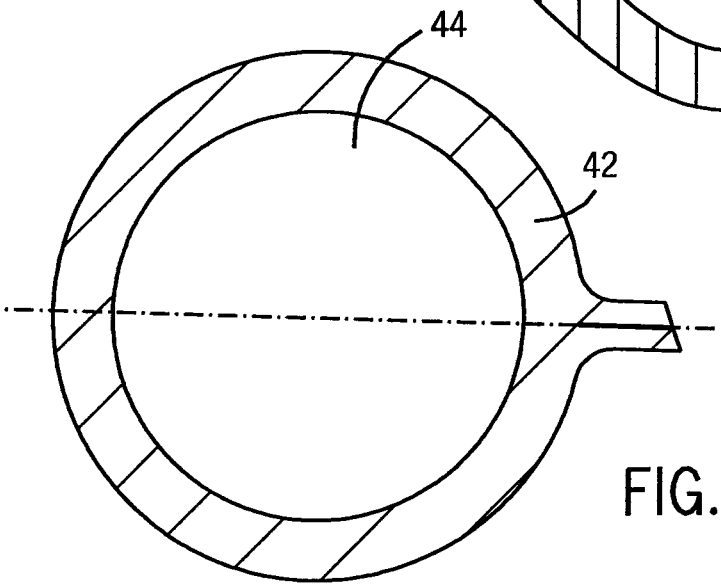
FIG. 8 is a cross-sectional view taken along line 8-8 of FIG. 2.

As the trapway 12 extends into the up leg 26, the passage 44 reduces in cross-sectional area, as shown in FIG. 4. The medial dimension reduces to approximately 2.1 inches and the lateral dimension reduces to approximately 2.6 inches. Additionally, the oval shape of the cross section of the passage 44 becomes slightly more slender.

As the up leg 26 begins to transition into the weir 28, the bottom portion 48 of the inner surface begins to flatten to form the water dam 30. Then, as the trapway 12 extends from the weir 28 to the down leg 32, the flat surface or crest of the water dam 30 disappears as the cross section of the weir 28 transitions into the essentially circular cross-sectional profile of the down leg 32. Although the down leg 32 is shown as transitioning into an essentially circular cross section, it is contemplated that the down leg 32 may also maintain an essentially D-shaped cross section.

As the weir 28 transitions into the down leg 32, the lateral dimension narrows from between 2 to 3 inches in the weir to between 2 and 2.35 inches in the down leg 32, and preferably to approximately 2.1 inches. In the down leg 32, this lateral dimension preferably matches the medial dimension. This progression from an essentially D-shaped cross section at the weir 28 to the essentially circular cross section of the down leg 32 can be seen in FIGS. 6-8.

Figure 9:
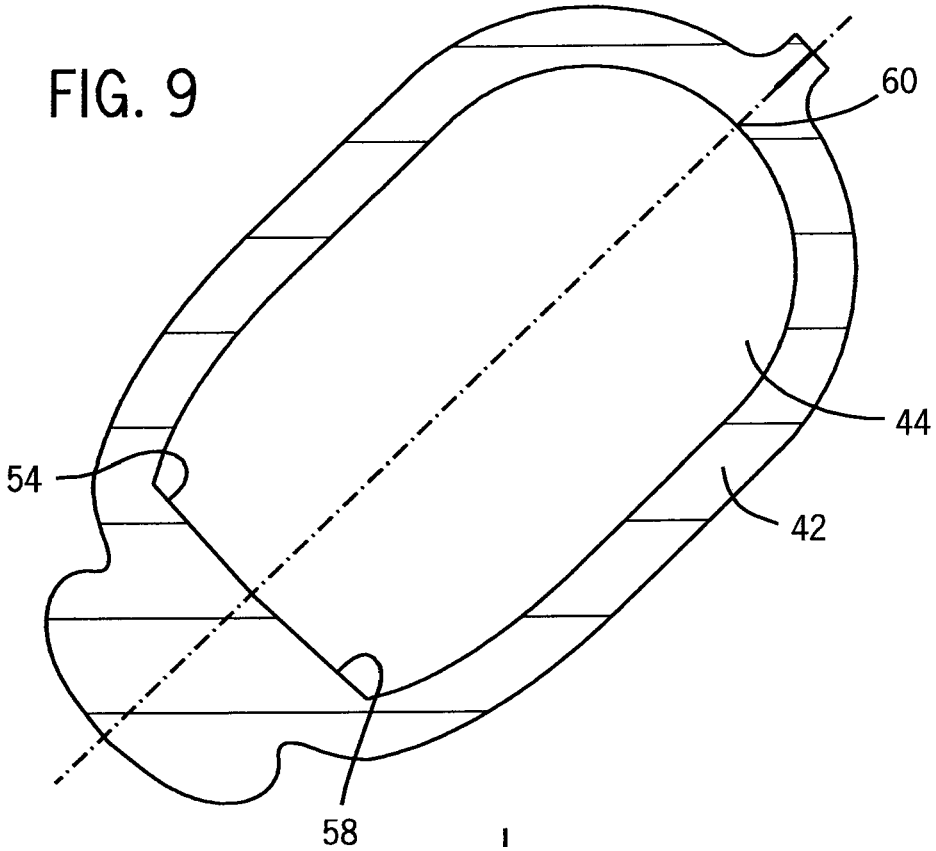
FIG. 9 is a cross-sectional view taken along line 9-9 of FIG. 2.

As the down leg 32 transitions into the heel 34, the passage 44 elongates in the medial direction as can been seen in FIG. 9. The medial dimension increases to between 3.2 and 3.7 inches, and preferably to approximately 3.5 inches. As the heel 34 bends and transitions into out leg 36, the medial and lateral dimensions return to between 2 and 2.25 inches, and preferably to approximately 2.1 inches.

As shown in FIG. 2, the outer bend 54 of the heel 34 has a straight flat portion 56 that turns into a radially-curved flat portion 58. The straight flat portion 56 is forms an angle of approximately 100 degrees with the direction of the out leg 36. When compared to an inner bend 60 of the heel 34, the outer bend 54 occurs more suddenly and forms a sharper bend than does the inner bend 60 which is relatively gradual and smooth.

Figure 10:
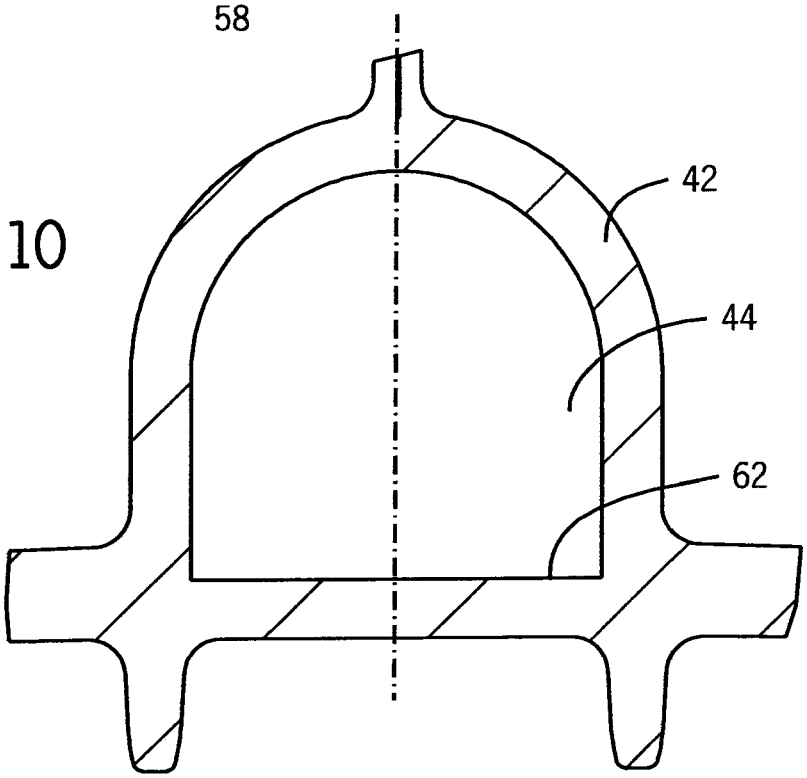
FIG. 10 is a cross-sectional view taken along line 10-10 of FIG. 2.

As can be seen in FIGS. 9 and 10, the radially-curved flat portion 58 that begins to form in the outer bend 54 of the heel 34 and merges with a flat bottom 62 of the out leg 36. This radially-curved flat portion 58 of the heel 34 can be seen in the otherwise ovular cross-section of FIG. 9. As the trapway 12 continues into the out leg 36, the radially-curved flat portion 58 of the heel 34 transitions into the flat bottom 62 of the essentially D-shaped cross section of the out leg 36 as shown in FIG. 10.

In addition to elongating in the medial direction, the passage 44 may also narrow in the lateral direction creating a pinch in the passage 44 at the heel 34 between the down leg 32 and the out leg 36.

It should be appreciated that although the heel 34 is shown and described as elongating and pinching such that the medial dimension is extended and the lateral dimension is reduced, that the heel 34 may elongate and pinch in other directions. In particular, at the heel 34 a major dimension increases during the transition from the down leg 32 to the heel 34. Likewise, in the transition from the heel 34 to the out leg 36, this major dimension decreases.

Although, as shown, this major dimension corresponds to the medial dimension, it is contemplated that the major dimension could be in directions other than the medial direction. The same is true of the "pinch" that is shown occurring along the minor dimension during the transition. It is contemplated that the minor dimension could lie along the lateral direction or along directions other than the lateral direction.

It is contemplated that the maximum cross-sectional area of the heel 34 can exceed the cross-sectional area of the down leg 32 adjacent to the heel 34. The maximum cross-sectional area of the heel 34 could exceed the cross-sectional area of the down leg 32 adjacent to the heel 34 by at least 25 percent. Likewise, the maximum cross-sectional area of the heel 34 may exceed the cross-sectional area of the out leg 36. Again, the difference in cross-sectional areas could be at least 25 percent.

It should be appreciated that the out leg 36 can extend in directions other than the essentially horizontal forward direction and may have cross-sectional geometries other than the essentially D-shaped cross section. For example, the out leg 36 may be relatively round in cross-sectional profile. Moreover, the out leg 36 may extend in a transverse or a rear direction. It is contemplated that the out leg 36 can be a double weir in a trapway having this heel feature.

The toilet 10, and the associated trapway 12, work in the following manner. Prior to being flushed, the bowl 18 and extent of the trapway 12 from the bowl opening 20 to the water dam 30 are filled with water. The height of the water dam 30 determines the height of the water in the bowl 18, as the slow or gradual addition of any further water to the bowl 18 would cause some water to flow over the water dam 30, although not a sufficient amount of water to form a siphon.

When the toilet 10 is flushed, water is forced into the bowl 18 and increases the water level in the bowl 18 to a height at or above the weir peak 29. This quick increase in the water level forces water further into the trapway 12 and fills the weir 28 and at least a portion of the down leg 32. The water flows through the down leg 32 which directs the water into a nearly spherical section at the outer bend 54 of the heel 32. This section focuses the flow streamlines of the water and causes a splash or hydraulic jump, thus initiating the siphon. The formation of the siphon initiates the draining of the waste water from the bowl 18 through the trapway 12. This siphon action may be assisted or prolonged by adjacent jets as will be shown in FIG. 11. In many toilets, such a jet or jets may be the primary action the initiates the formation of a siphon.

The cross-sectional area generally decreases as the trapway 12 extends from the weir 28 to the down leg 32, but the velocity of the waste water increases as it progresses through the smaller cross-sectional areas and then decreases as it moves through portions of the trapway 12 having larger cross sectional areas. Thus, it can be generally stated that the velocity of the water in the down leg 32 is greater than the velocity of the water in the heel 34 and that the velocity of the water in the out leg 36 is greater than in the heel 34, but somewhat less than that in the down leg 32. The differential velocities, coupled with the geometry of the heel 34, reduce the likelihood of blowback, thus forming a seal.

It should be particularly noted that because the pinching and focusing of the water flow occurs along an extended slope of the heel, the heel self-adjusts for varied waste content when the siphon is initially being formed. Hence, the heel design is a reliable siphon formation feature. The design of the trapway 12 equally improves the ability of the trapway 12 to maintain a siphon at the end of the flush cycle.

Figure 11:
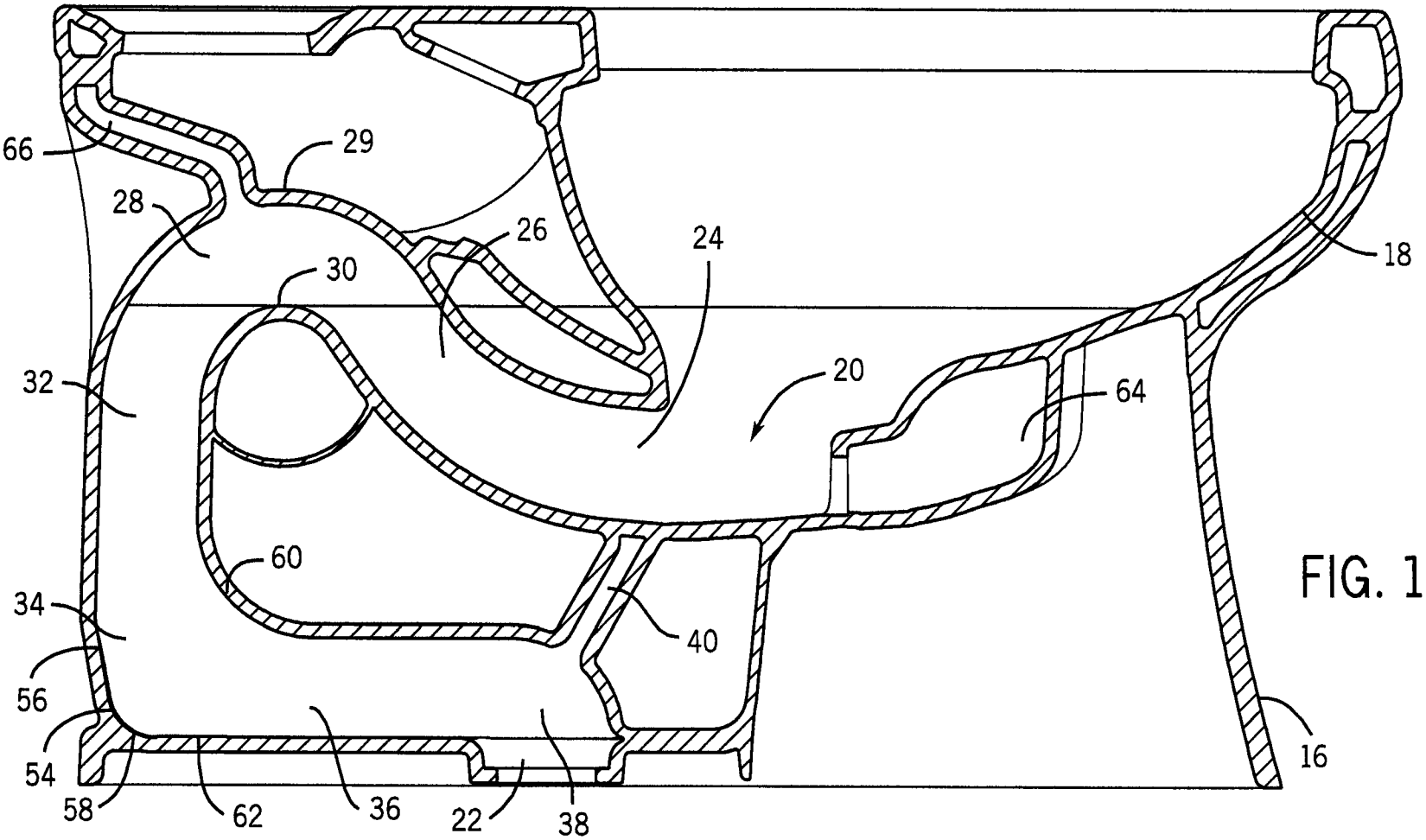
FIG. 11 is a vertical cross-sectional view of a second embodiment according to the present invention.

In another embodiment, as shown in FIG. 11, the trapway 12 is shown having a slightly alternative geometry from that shown in FIGS. 1-10. In particular, the up leg 26 extends a further distance as it gradually approaches the weir 28. The embodiment shown in FIG. 11 also has a jet supply conduit 64 that assists in flushing action. This embodiment also has a cavity 66 extending from the upper surface of the weir 28 towards the flush tank 14.

It should be appreciated that preferred embodiments of the invention have been described above. However, many modifications and variations to the preferred embodiments will be apparent to those skilled in the art, which will be within the spirit and scope of the invention. For example, instead of a gravity flow tank, the tank could be provided with a pump or other means to provide more force to the water, or a controller to more specifically sequence flows between the rim and jet.

Therefore, the invention should not be limited to the described embodiments. To ascertain the full scope of the invention, the following claims should be referenced.

INDUSTRIAL APPLICABILITY

The invention provides toilets that more efficiently flush waste material due to improved trapways used therewith.

What is claimed is:

1. A toilet comprising:

a trapway extending between a bowl opening and a toilet outlet, the trapway extending from the bowl opening to a weir above the bowl opening, then to a down leg, then to a heel, then to an out leg;

wherein the heel links and provides a bend between the down leg and the out leg, the heel having a cross-sectional profile having a major dimension and a minor dimension, the major dimension increasing as the down leg transitions into the heel and also reducing as the heel transitions into the out leg, and the minor dimension reducing as the down leg transitions into the heel and increasing as the heel transitions into the out leg;

wherein the down leg has a cross-sectional profile that is essentially circular, and the trapway is capable of generating a siphon during a flushing action of the toilet;

wherein a portion of the down leg has a constant medial dimension and extends straight; and wherein a portion of the out leg has a constant medial dimension and extends straight.

2. The toilet of claim 1, wherein the reduction of the minor dimension as the down leg transitions into the heel focuses flow through the trapway at the heel to generate a hydraulic jump and thereby facilitate formation of a siphon in the trapway during a flushing action of the toilet.

3. The toilet of claim 2, wherein the down leg and the out leg each have a major dimension of between 2 and 2.25 inches and a minor dimension of between 2 and 2.25 inches, and the heel has a major dimension of between 3.2 and 3.7 inches.

4. The toilet of claim 1, wherein the out leg has a cross-sectional profile that is essentially D-shaped.

5. The toilet of claim 4, wherein the heel has a side wall having an inner surface, and at least a portion of the inner surface of the side wall has a flat portion that transitions into a flat bottom of the out leg.

6. The toilet of claim 1, wherein a maximum cross-sectional area of the heel exceeds a cross-sectional area of the down leg adjacent to the heel.

7. The toilet of claim 6, wherein a maximum cross-sectional area of the heel exceeds a cross-sectional area of the down leg adjacent to the heel by at least 25 percent.

8. The toilet of claim 1, wherein the down leg is essentially vertical from the weir to the heel and the out leg is essentially horizontal.

9. The toilet of claim 8, wherein the out leg extends in a forward direction.

10. A toilet comprising:

a bowl including an opening; and a trapway including an inner passage that includes an up leg, a down leg having a straight vertical portion, and an out leg having a straight horizontal portion, the trapway being configured to connect the bowl opening to a waste line;

wherein a transition between the down leg and the out leg includes an outer bend and an inner bend, the outer bend and the inner bend each extending from the down leg to the out leg;

wherein the outer bend includes a curved portion that is sharper than the inner bend;

wherein the transition between the down leg and the out leg has a cross-sectional area that is greater than a cross-sectional area of the down leg and is also greater than a cross-sectional area of the out leg;

wherein no portion of the outer bend between the down leg and the out leg is convex; and wherein in the transition from the down leg to the out leg, the lateral dimension decreases then increases.

11. The toilet of claim 10, wherein an angle between the down leg and the out leg is approximately 100 degrees.

12. The toilet of claim 10, wherein the trapway has a medial dimension and a lateral dimension; and wherein in the transition from the down leg to the out leg, the medial dimension increases then decreases.

13. The toilet of claim 10, wherein the out leg transitions to the waste line at an outlet bend, and wherein the outlet bend is approximately 90 degrees.

14. The toilet according to claim 1, wherein during a flush cycle, water in the down leg and in the out leg has a greater velocity than the water in the heel, the velocity of the water in the out leg being less than the velocity of the water in the down leg.

15. The toilet of claim 14, wherein the trapway progresses from a substantially D-shaped cross section at the weir to a substantially circular cross section at the down leg and then back to a substantially D-shaped cross section at the out leg.

16. The toilet of claim 1, wherein the heel includes an outer bend and an inner bend each of which extend from the down leg to the out leg, the outer bend includes a curved portion that is sharper than the inner bend, and no portion of the outer bend between the down leg and the out leg is convex.

17. The toilet of claim 16, wherein the heel has a cross-sectional area that is greater than a cross-sectional area of the down leg and that is also greater than a cross-sectional area of the out leg.

18. The toilet of claim 17, wherein during a flush cycle, water in the down leg and in the out leg has a greater velocity than the water in the heel, the velocity of the water in the out leg being less than the velocity of the water in the down leg.

19. The toilet of claim 10, wherein the outer bend of the transition includes a straight portion that is positioned above and connects to the curved portion.

* * * * *